US005876275A

United States Patent [19]

Rasmussen

[11] Patent Number: 5,876,275

[45] Date of Patent: Mar. 2, 1999

[54] ESCALATOR WITH ADJUSTABLE COIN GUIDES

[75] Inventor: James M. Rasmussen, Chicago, Ill.

[73] Assignee: Wms Gaming Inc., Chicago, Ill.

[21] Appl. No.: 790,843

[22] Filed: Jan. 30, 1997

[51] Int. Cl.[6] ..... G07D 9/04

[52] U.S. Cl. ..... 453/32; 194/344; 221/267

[58] Field of Search ..... 194/344, 334; 453/32; 221/267; 193/DIG. 1

[56] References Cited

U.S. PATENT DOCUMENTS 4,592,377 6/1986 Paulsen et al. .

FOREIGN PATENT DOCUMENTS 0311320 4/1989 European Pat. Off. ..... 453/32

311320 4/1989 European Pat. Off. ..... G07D 1/00

2335006 7/1977 France ..... 453/32

3522119 1/1986 Germany ..... G07D 1/02

3-0157793 7/1991 Japan ..... 194/334

1066779 4/1967 United Kingdom ..... 453/32

WO 90/02389 3/1990 WIPO ..... G07D 9/04

*Primary Examiner*—F. J. Bartuska

*Attorney, Agent, or Firm*—Rudnick & Wolfe

[57] ABSTRACT

A coin escalator assembly has coin guide plates adjustably mounted in slots. Slots positioned in the upper end of the escalator assembly allow the coin guide plates to be adjusted for variation in coin diameter. By making the escalator assembly adjustable, within a predetermined range, a single escalator may be used to cover a range of coin sizes.

5 Claims, 5 Drawing Sheets

ESCALATOR WITH ADJUSTABLE COIN GUIDES

BACKGROUND OF THE INVENTION

This invention relates generally to coin and token handling in gaming devices that dispense coins or tokens as winnings. The present invention relates more specifically to an improved escalator assembly for transporting coins or tokens from a payout hopper in a gaming device to a payout trough positioned above the hopper on the device. By making the escalator assembly adjustable to accommodate a predetermined range of diameters of coins or tokens, a single escalator may be used.

In many gaming devices, it is desirable to provide transfer of coins from a collection hopper to a coin cup which is elevated with respect to the hopper via an escalator. The use of an escalator as a conveyor to transport coins in a generally vertical, upward direction is a known industry method.

Driving members within a coin hopper feed coins from the hopper into a lower end of the escalator in a single, edge-to-edge orientation. Coins are pushed through the escalator by the driving members within the hopper. The coins are discharged at the outlet end of the escalator into a payout trough. In certain gaming devices of the type described herein, coin guides placed near the outlet end of the escalator direct coins into the payout trough.

A counting device is positioned near the outlet slot to count the number of coins ejected during a payout. When the counter reaches the number of coins to be ejected, no more coins are fed into the channel by the hopper. In one such counting device, a roller arm is positioned in the coin path such that its movement by a passing coin causes actuation of a switch to signal a coin count. Due to the nature of the industry, an exact number of coins must be dispensed at each payout.

Due to variations in diameters of coins used by various gaming devices, the stack height of coins within an escalator can vary considerably. This variation in stack height can result in counting errors and consequently overpays or underpays during a coin payout.

One solution to this problem is to provide a custom escalator for specific coin diameters. This solution requires increased costs and overhead expenses because, to assure timely delivery of customer orders, a sufficient quantity of each custom escalator would need to be forecast, scheduled and maintained in inventory.

It is accordingly an object of the present invention to provide an improved coin escalator assembly whereby these disadvantages of the prior art are overcome.

It is a further object of the invention to provide an improved coin escalator assembly, whereby a single adjustable escalator may be used to accommodate a range of coin diameters.

It is a further object of the invention to provide an improved coin escalator assembly for preventing counting errors of coins or the like during a payout.

A further object of the invention is to provide an improved coin escalator assembly which is both accurate and simpler than existing techniques.

These and other objects of the invention will be apparent from the remaining portion of the specification.

SUMMARY OF THE INVENTION

The present invention comprises a coin escalator assembly having an upper end that is adjustable within a predetermined range to accommodate different coin diameters. Coin guides are adjustably mounted by positioning slots in the upper end of the escalator assembly. The slots allow the positions of the coin guides to be adjusted, and hence the length of the escalator coin path to be adjusted to accommodate a predetermined coin diameter. A correct coin count is dependent upon a correct length of the escalator channel. By making the upper end of the escalator assembly adjustable, a single escalator may be employed for a predetermined range of coin or token diameters.

DETAILED DESCRIPTION OF THE PREFERRED EMBODIMENT

Figure 1:
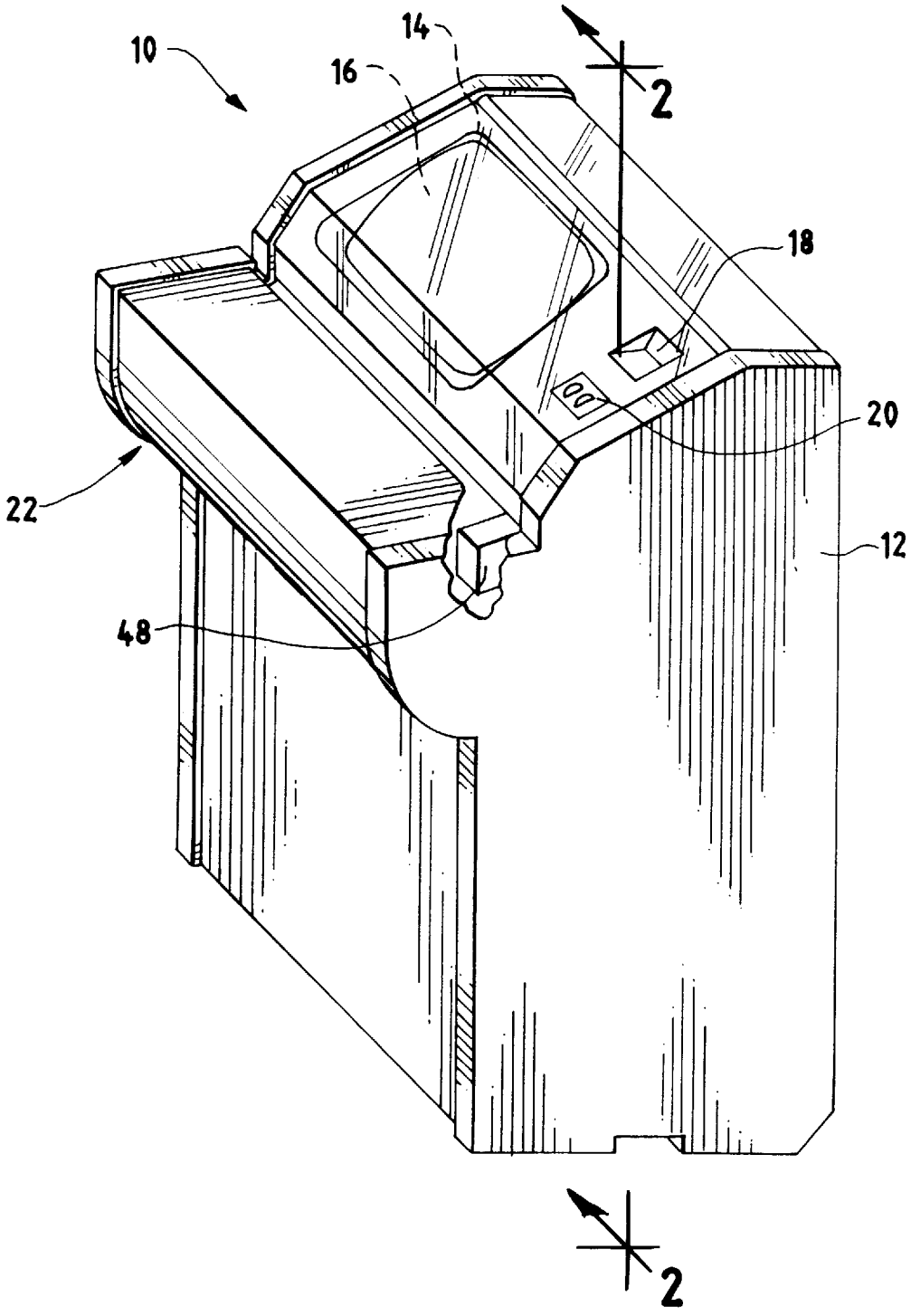
FIG. 1 is a perspective view of a gaming device suitable for use with the present invention.

Referring to FIG. 1, there is illustrated generally a gambling device 10 suitable for use with the present invention; only the essential features necessary for an understanding of the invention are shown. Gaming device 10 comprises a cabinet 12 having a viewing window 14 provided therein through which the player may observe a video screen 16. Alternatively, video screen 16 could be replaced by a plurality of reels or the like.

Gaming device 10 includes a dollar bill acceptor 18 and coin slot 20. Coin slot 20 serves to deliver the inserted coins or tokens into a hopper 24 (FIG. 2) and bill acceptor 18 delivers the inserted bills into a bill validator and stacker (not shown). If a player wins and wishes to cash out, the payoff in coins or tokens is deposited into payout trough 22 as discussed hereinafter.

Figure 2:
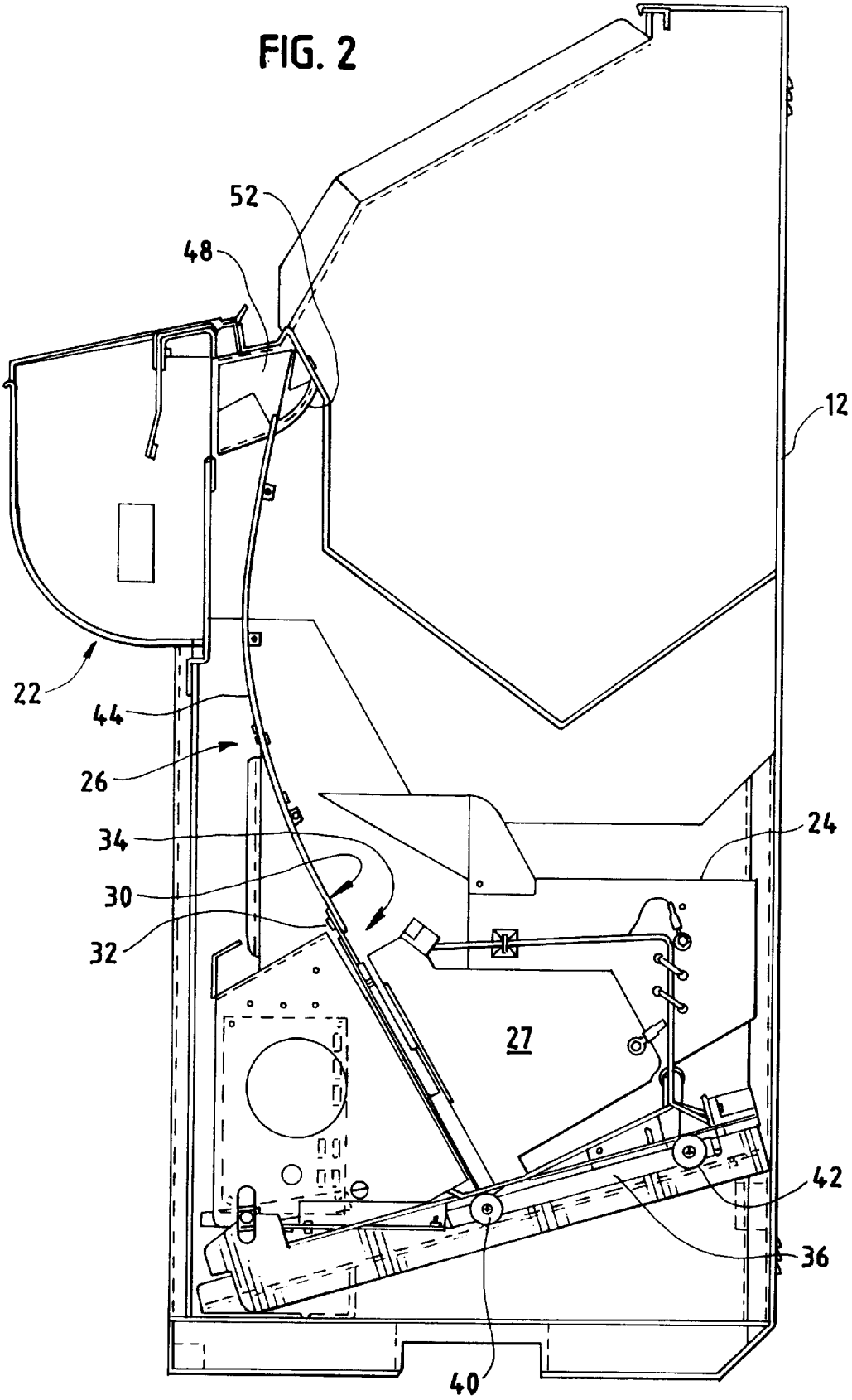
FIG. 2 shows a cross-sectional elevational view of a gaming device with a coin escalator assembly, coin hopper and coin dispensing assembly.

Referring to FIG. 2, escalator 26 is secured to the hopper 24. Coin hopper 24 is open at its top to receive coins or tokens deposited into coin slot 20. The lower end 30 of escalator 26 is removably secured to the hopper 24 by screws 32 (or other suitable mounting means). Hopper 24 and escalator 26 are supported on mounting sled 36. Sled 36 includes a frame supported on a plurality of rollers 40 and 42 which engage with a suitable mounting structure on the bottom of cabinet 12 to correctly orient the hopper 24 therein. Alternatively, the hopper 24 and escalator 26 could be attached to a mounting plate in the bottom of cabinet 12.

A supply of coins is delivered from the hopper 24, to an inlet 34 at the lower end of the escalator 26 in a single edge-to-edge orientation. Coin delivery to the escalator and coin flow through the escalator is controlled by conventional coin driving mechanism 27 housed within the coin hopper.

The escalator assembly further comprises an elongated channel 44 through which a stack of coins of a single denomination pass in an edge-to-edge file to an outlet 48 adjacent the upper end of the escalator assembly.

Escalator assembly 26 is positioned to release coins into a coin cup port 52 (FIG. 2) adjacent its upper end. In operation, when a coin payout is to be made, a controller (not shown) directs a hopper motor associated with mechanism 27 to start, whereby coins are delivered into and transported up channel 44 and discharged into coin cup port 52.

Figure 3:
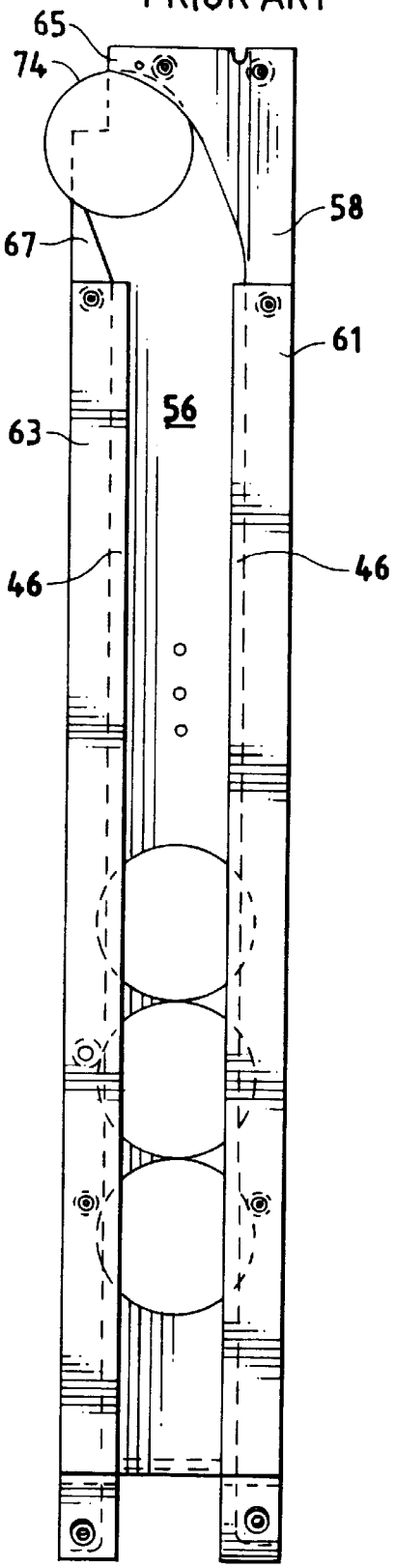
FIG. 3 PRIOR ART
FIG. 3 is a front view of a prior art escalator assembly.

Referring to FIG. 3, a prior art coin escalator is shown generally. Coin transport channels 46 are formed on the outside surface of plate 56. Channels 46 are defined by plate 56, spacer plate 58, edge plate 61, spacer plate 60 and edge plate 63. The distance between the Channels 46 is slightly greater than the diameter of the coins for which it is intended and has a depth which is slightly larger than the thickness of such coins.

Coin outlet guides 65 and 67 are provided adjacent the upper end of the escalator to guide coins, such as, for example, coin 74, into the coin cup via conventional means (not shown) such as a roller arm positioned in the coin path.

Figure 4:
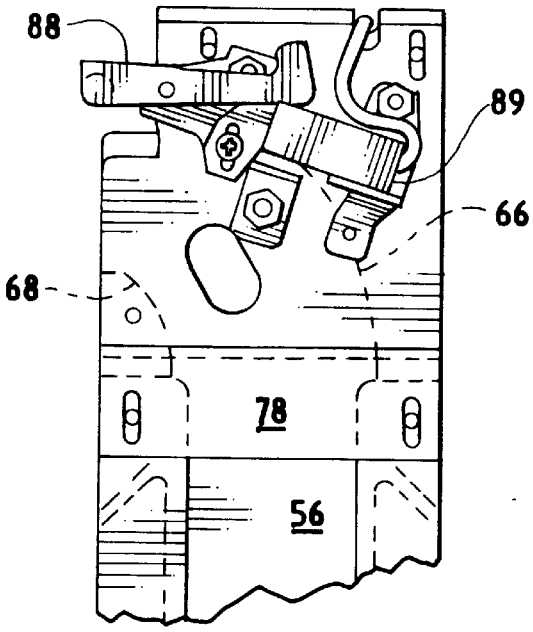
FIG. 4 is a front view of a portion of the coin escalator assembly of the invention.
Figure 5:
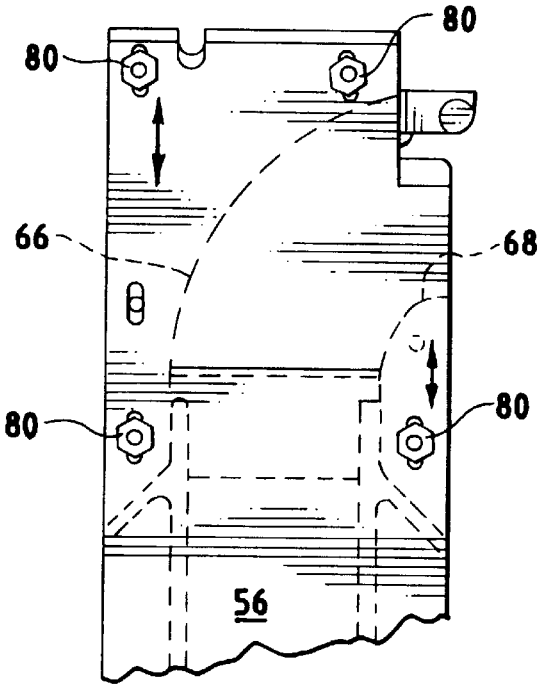
FIG. 5 is a rear view of a portion of the coin escalator assembly of the invention.

FIGS. 4 and 5 show partially broken away views of the front and rear sides of the outlet end of the improved escalator assembly of the present invention. First and second coin outlet guides 66 and 68 are shown in phantom and are positioned in contact with the upper end of inner plate 56 in such a manner to provide a coin path for coins to be dispensed into a fixed cup port when coins are to be paid out. A cover plate 78 is shown mounted to the outlet end of the escalator assembly by mounting means (FIG. 5) 80, preferably screws and nuts as shown.

A roller arm 88 is shown mounted to cover plate 78 and positioned in the coin path. Movement of the roller arm by passing coins actuates a switch 89, to permit counting of the number of coins dispersed. The roller arm typically is spring loaded to maintain contact with the passing coin and to aid in the dispensing of the coin by exerting a positive spring return force. Such a configuration eliminates actuator "bounce" which can signal false coin counts.

The counter switch 89 is connected to a controller (not shown) which controls the motor in the hopper forcing the coins into the escalator 26, so that when the counter reaches a predetermined number the motor is shut off.

Figure 6A:
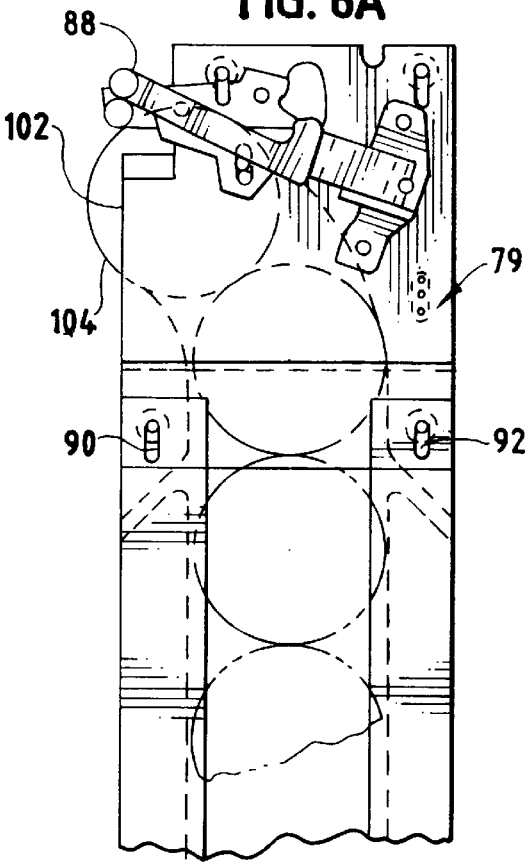
FIGS. 6*a–c* are section views of the upper end of the coin escalator assembly of the invention partially broken away, illustrating the adjustable nature thereof to accommodate a range of coin diameters.
Figure 6B:
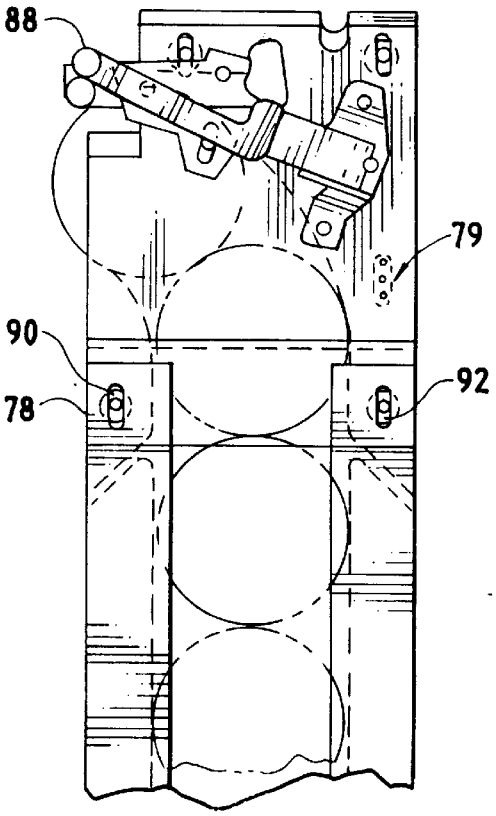
Figure 6C:
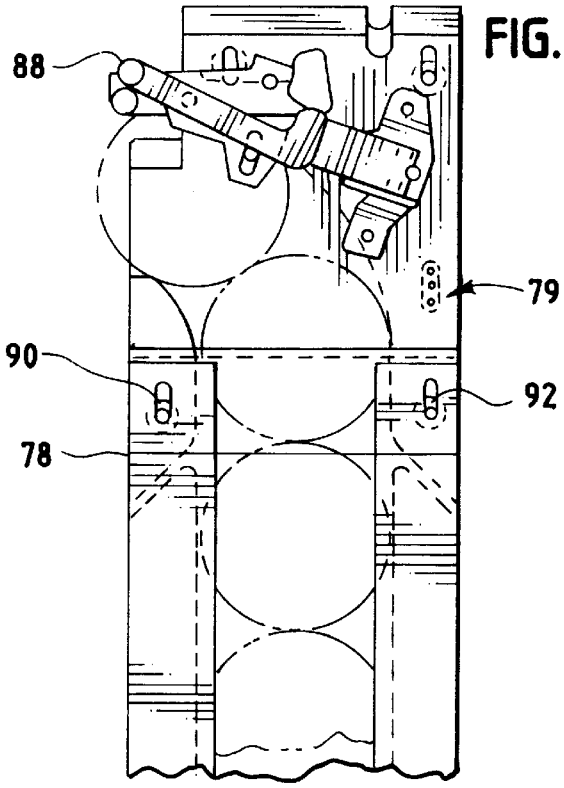

Referring now to FIGS. 6*a–c*, according to the present invention, the relationship of the roller arm 88 to the coin exit port 102 is set to dispense the correct number of coins. Once the controller determines that the last coin has been ejected, the hopper motor is stopped so that no more coins are forced into the channel and the next coin, 104 rests in the positions shown in FIGS. 6*a–c*.

Figure 7:
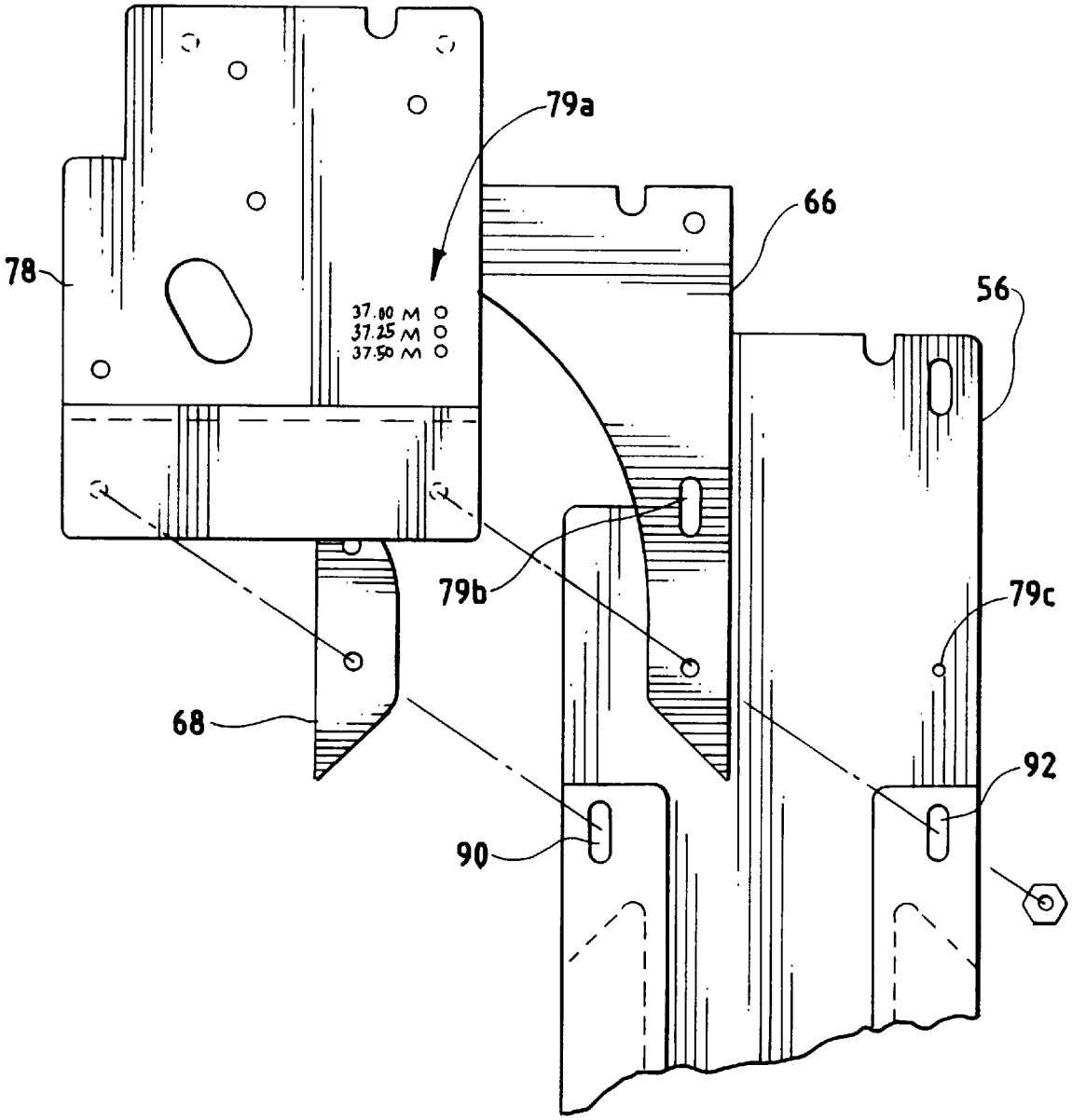
FIG. 7 is an exploded view of the coverplate and guide assemblies.

As best shown in FIGS. 6*a–c* and 7, the cover plate 78 carries the sensor assembly, and inner and outer guides to permit adjustment to positions for differing coin stack heights. By means of slots 90 and 92, the position of coin guides 66 and 68 can be adjusted to correspond to different coin stack heights within a predetermined range. Screws lock the cover 78 in the selected position. A visual position indicator feature is illustrated at 79. Its appearance reflects the position of the coin guides 66 and 68 in slots 90 and 92. It consists of position holes 79A, slot 79B and indicator hole 79C (FIG. 7). If desired, the indicator 79 may be calibrated to specific coin sizes as illustrated in FIGS. 6*a–c*.

In FIG. 6*a*, the coin guides are positioned within the slots to accommodate a coin having the largest acceptable diameter. In FIG. 6*b*, the coin guides are positioned within the slots to accommodate a coin having a mid-range diameter, thereby decreasing the overall length of the coin path. In FIG. 6*c*, the coin guides are positioned within the slots to accommodate a coin having the smallest diameter within a predetermined range. These settings permit changing the coin path length quickly to accommodate a desired coin diameter. Importantly, they maintain the correct relationship between the coins as they are dispensed by the switch roller arm 88. That is, regardless of selected coin diameter, the arm 88 is correctly positioned so it counts only coins dispensed. It does not give a false signal due to a coin to be dispensed resting against it between dispensing operations.

The amount of adjustment, which will vary due to diameter ranges of different coin and token denominations, must satisfy the following conditions. The lowest coin exit position must dispense the coin reliably into the coin cup port. The highest coin exit position must not create an escalator height which interferes with its surroundings. The adjustment permits the same escalator to be used with various sized coins. Instead of having several sizes of escalators, one adjustable escalator according to the invention is suitable. By correctly adjusting for a given coin diameter, accurate operation of the coin counting mechanism is assured due to the correct positioning of a coin relative to the arm 88 as it is dispensed. False counts are virtually eliminated.

While the invention has been shown and described with reference to a preferred embodiment thereof, it will be understood by those skilled in the art that various changes in form and detail may be made therein without departing from the spirit and scope of the invention.

What is claimed is:

1. In a coin escalator for conveying coins from a supply hopper to a dispensing location and including switch means for counting coins as they are dispensed from the escalator the improvement comprising:

(a) means for adjusting the length of the coin path between at least two positions to accommodate coins of a selected diameter, said adjusting means maintaining the correct relationship between coins of said selected diameter and said switch means to insure accurate counting of the number of coins dispensed; and (b) said switch means including a roller arm being firstly positioned so as to contact a coin as it is dispensed, whereby movement of said roller arm actuates said switch means, said roller arm being secured to said adjusting means for movement therewith, whereby the roller arm is positioned as a function of coin diameter to insure accurate counting of coins dispensed.

2. In a coin escalator for conveying coins from a supply hopper to a dispensing location and including switch means for counting coins as they are dispensed from the escalator the improvement comprising:

(a) means for adjusting the length of the coin path between at least two positions to accommodate coins of a selected diameter, said adjusting means maintaining the correct relationship between coins of said selected diameter and said switch means to insure accurate counting of the number of coins dispensed, wherein said means for adjusting includes a cover plate adapted to be secured to the upper end of said escalator in at least two positions corresponding to different coin diameters, said cover plate carrying said switch means and coin guides (66, 68) for directing coins to be dispensed.

3. The escalator of claim 2 wherein said switch means includes a roller arm positioned to contact a coin as it is dispensed, movement of said roller arm actuating said switch means.

4. The escalator of claim 3 wherein said roller arm is secured to said adjusting means for movement therewith;

whereby the roller arm is positioned as a function of coin diameter to insure accurate counting of coins dispensed.

5. The escalator of claim 2 further including a position indicator to permit visual determination of the current position of said coin guides (66, 68).

* * * * *